United States Patent [19]

Alphonse

[11] Patent Number: 4,911,897

[45] Date of Patent: Mar. 27, 1990

[54] SERIAL DILUTION AND HOMEOPATHIC POTENTIZATION DEVICE

[75] Inventor: Jean Alphonse, Vinay, France

[73] Assignee: Co Artz, Tullins, France

[21] Appl. No.: 280,785

[22] Filed: Dec. 7, 1988

[30] Foreign Application Priority Data

Dec. 8, 1987 [FR] France ..... 87 17370

[51] Int. Cl.[4] ..... B01F 11/00

[52] U.S. Cl. ..... 422/270; 422/261; 422/281; 422/100; 422/65; 436/179; 436/180; 73/864.23; 73/864.24

[58] Field of Search ..... 422/65, 100, 261, 270, 422/281; 436/43, 47, 48, 52, 53, 54, 174, 179, 180; 73/864.23, 864.24, 864.25; 366/108, 185, 132, 134, 135, 159, 160, 185, 187

[56] References Cited

U.S. PATENT DOCUMENTS

| | | | |
|---|---|---|---|
| 3,614,434 | 10/1971 | Horwitz et al. | 436/43 |
| 3,790,347 | 2/1974 | Fletcher et al. | 366/185 |
| 4,217,780 | 8/1980 | O'Connell et al. | 73/864.25 |
| 4,475,411 | 10/1984 | Wellefors | 73/864.24 |
| 4,746,491 | 5/1988 | Ohlin | 422/100 |

FOREIGN PATENT DOCUMENTS

| | | |
|---|---|---|
| 0132480 | 2/1985 | European Pat. Off. . |
| 90566 | 1/1973 | Fed. Rep. of Germany . |
| 2110066 | 5/1972 | France . |
| 2412358 | 7/1979 | France . |
| 2574659 | 1/1987 | France . |

*Primary Examiner*—Kenneth M. Schor
*Assistant Examiner*—Greogry R. Muir
*Attorney, Agent, or Firm*—Browdy and Neimark

[57] ABSTRACT

An automated device for deconcentration and potentiation of homeopathic remedies, comprising a preparations flask held by a support fastened to a horizontal shaft driven in rotation. The mouth of the flask describes a circle and can be moved among several positions, particularly an original position for introduction of the dose to be diluted or rediluted and for introduction of the solvent, and a position for pouring the dilution into a wide-mouth bottle containing granules to be impregnated and put into rotation. Between each deconcentration, the flask is cleaned by washing means and drying means located on its path in other positions.

6 Claims, 4 Drawing Sheets

FIG. 6
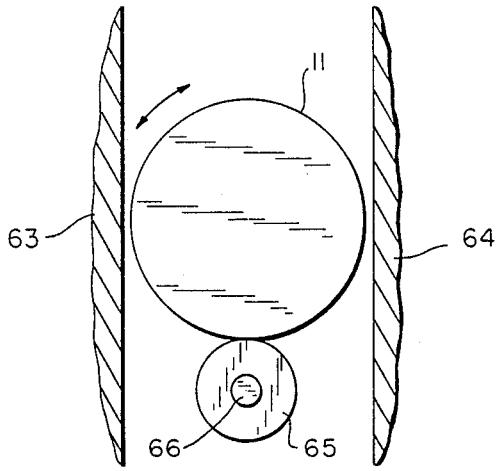
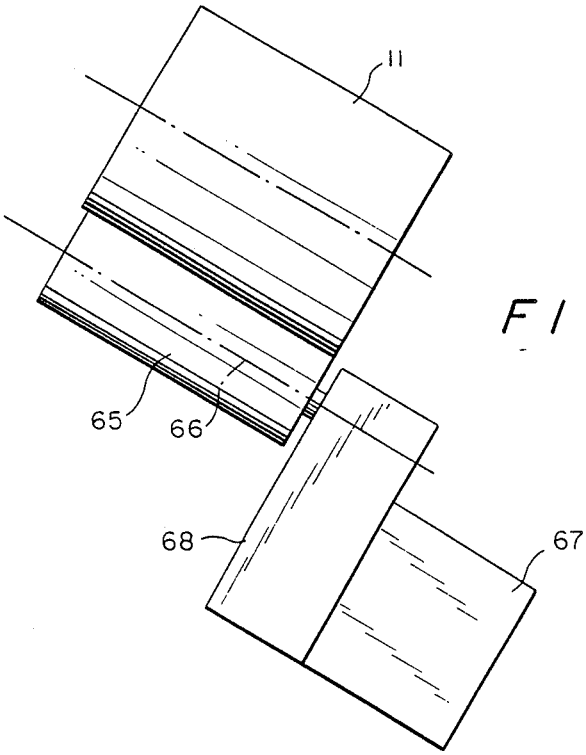
FIG. 7

SERIAL DILUTION AND HOMEOPATHIC POTENTIZATION DEVICE

FIELD OF THE INVENTION

This invention relates to an automatic device for serial dilution of homeopathic remedies up to impregnation and drying of the granules, starting from the manual introduction of a dose of mother tincture or other types of original preparations selected by the preparer to be prepared automatically.

BACKGROUND OF THE INVENTION

Equipment performing this function is already found in specialized laboratories, but, as it is designed to assure a large, continuous production, it is really not suited for preparations made in the pharmacy. Now, laboratories specialized in making homeopathic medicines are often geographically distant from distributing pharmacies, which causes the imponderable deliveries to pharmacies to represent a considerable proportion of the cost of medicines, despite a policy of territorial distribution of the laboratories and their branches. Moreover, these services are interrupted on certain days and since homeopathy is also a therapy of acute illnesses, a certain number of pharmacists undertake making of certain preparations rather than maintain a complete stock that would not "move" enough. In view of the need of preparation at the pharmacy of certain homeopathic remedies, some pharmacists do not hesitate to equip themselves with current equipment suitable for laboratories, such as laminar flow hoods, constant volume pipets and distributors of the same type, to prepare manually and on demand certain potencies from the single stock of homeopathic original preparations.

SUMMARY OF THE INVENTION

The device according to the invention makes it possible to remedy these drawbacks. It was designed especially to answer this problem of making available to the preparing pharmacist and for a small investment all that is necessary for his practice under technical conditions comparable to those of specialized laboratories, these conditions aiming at the quality of the products, and particular avoiding contamination during the cycles of serial dilution, up to the transfer of the finished remedy into commercial forms.

For this purpose, the device of homeopathic remedies according to the invention essentially comprises, in its principle, at least one preparations flask which is held by a means that is fastened to a shaft that is approximately horizontal and free in rotation, the preparations flask being approximately perpendicular to the shaft, and means being provided to drive the preparations flask in rotation around this shaft and to index it angularly so that the mouth of the flask describes a circle whose center is located on the shaft, the device also comprising, on the pouring path of the flask, the mouth of a wide-mouth bottle to contain impregnated granules and a used solution receptacle, as well as cleaning means located close to the lowest point of the pouring path of the flask, this flask having an original position for introduction of the dose to be diluted or rediluted and of the solvent.

In the simplest form, the device comprises a single preparations flask, whose mouth describes a circle and can be moved between several positions on the circle, the flask being cleaned between each of the dilutions of the same preparation. Advantageously, the means for cleaning the flask comprise, besides washing means, for example providing tap water and then distilled water, a drying means located on the circular path of the flask mouth.

Preferably, the shaft to which the preparations flask is fastened is not only free in rotation but also free in translation, and means are provided to transmit an axial, alternating movement to this shaft to perform successions.

The device which is object of the invention is installed, with its accessories, in a laminar flow enclosure, decontaminated continuously, whose facilities make available products as well as equipment used with the device. In a preferred embodiment the necessary unit, which includes all that is necessary for the preparing pharmacist, is installed in a column each of whose stages has a specialized assignment. The upper part is reserved for the system filtering the air taken from the atmosphere. Just below this is located the row of mother tincures and other original preparations used in the dilutions. On the ergonomic level then, in the laminar flow enclosure, is the equipment assuring the operations of making remedies. All the lower part is reserved for storing the granule packagers as well as storage of the specific liquids of the production cycle.

Other characteristics and advantages of this invention will come out from the following detailed description of a preferred embodiment, which is given by way of nonlimiting example, with reference to accompanying diagrammatic drawing in which:

BRIEF DESCRIPTION OF THE DRAWING

FIGS. 6 and 7 are sectional and side views, respectively, of the wide-mouth bottle containing the granules to be impregnated and the means for keeping and driving in rotation, in case of a variant.

DETAILED DESCRIPTION OF THE INVENTION

Figure 1:
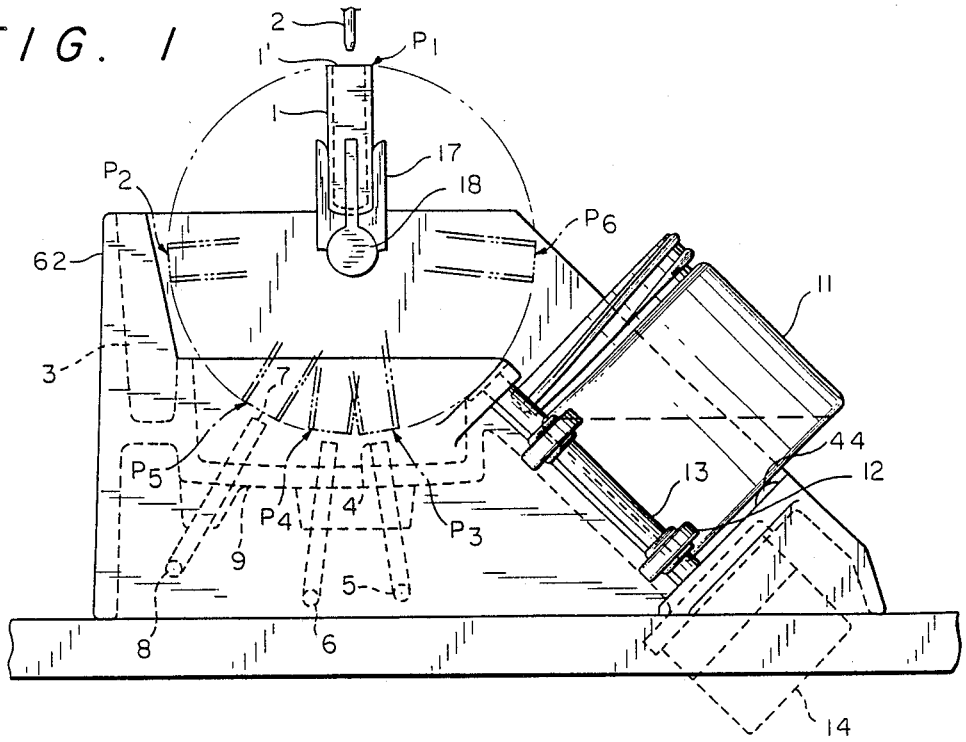
FIG. 1 is a front view of the serial dilution device which illustrates all the operating cycle, up to the impregnation of the granules.
Figure 3:
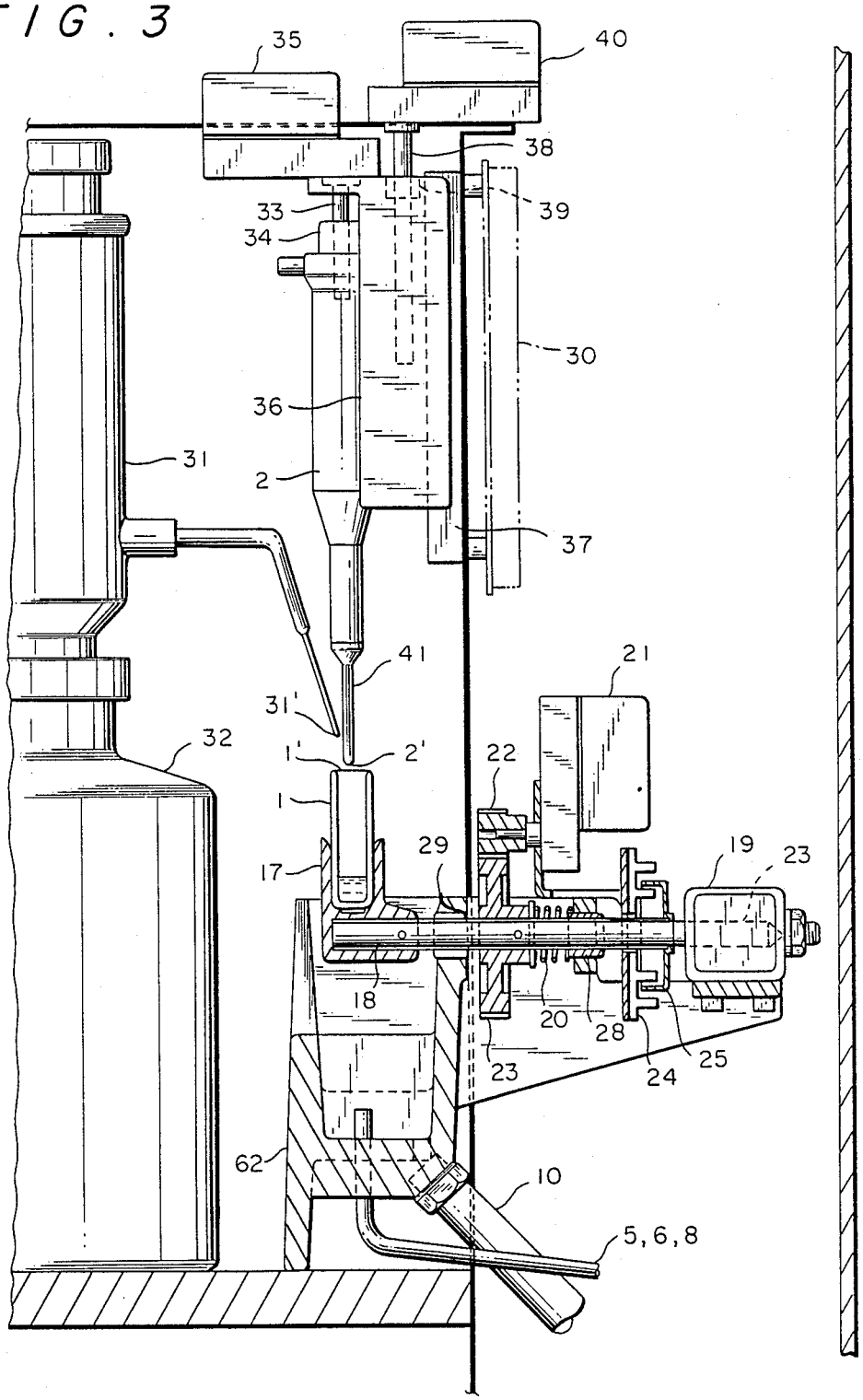
FIG. 3 is a section made in the axis of the serial dilution device along a vertical plane.

The device comprises a preparations flask 1 held removably on a support 17 fastened to one end of a horizontal shaft 18, as shown in FIGS. 1 and 3, shaft 18 being mounted mobile in rotation and translation. This shaft 18, in the nonlimiting example described here, consists of a tube, to reduce its inertia. At the other end of shaft 18 is provided an electromagnet 19 which provides the successions necessary for the potentization. The core of electromagnet 19 is fastened to shaft 18, which then causes, during the functioning of electromagnet 19 that works with a spring 20, an alternating movement with impacts of preparations flask 1 by shaft 18, which slides freely in smooth bearings 28 and 29. In regard to the circular movement of flask 1, a gear 23 with spur toothing, preferably of plastic, which receives an angular movement by a pinion 22 coupled to the output of a gear motor 21, can be seen in the median part of shaft 18 and fastened relative to it. The angular movement assures the movement of flask 1 to various positions P1 to P6, positions indexed by a means which comprises the cooperation of photodiodes 24 with a perforated crown 25, integral with shaft 18. Thus, when this perforated crown 25 exhibits one or more slots opposite photodiodes 24 combined with them, data is had on angular positions P1 to P6 and, as a function of the data, gear motor 21 is controlled from an electronic card 30.

To assure supplying of flask 1 with solvent, a known means is used which consists of a distributor with adjustable volume with automatic control 31 mounted on a flask 32 containing solvent. To remove the diluted solution that is to be diluted in a new solvent for each of the deconcentrations, there is used another known means with a micropipet 2 which is motorized by a nut and bolt mechanism 33 and 34 operated by a gear motor 35. Micropipet 2 is mounted on a carriage 36 sliding in a dovetail support, carriage 36 receiving an alternately descending and rising movement from another nut and bolt mechanism 38 and 39 operated by a gear motor 40. Thus, during the descending movement, lower end 2' of micropipet 2 reaches the level of the diluted solution at the bottom of flask 1, which allows the amount required for the next deconcentration to be removed. And during the new presentation of flask 1 after it has been washed and dried, the amount of solution previously removed is returned for a new dilution. Completing this operation, the solvent jet coming from end 31' of automatic distributor 31 being directed on end 2' of micropipet 2 has the effect of returning even dilution traces that can adhere to end 2' of micropipet 2. It should also be noted that tip 41 of micropipet 2 is interchangeable between each of the different preparations at the same time as flask 1 in case of suspicion of pollution.

Figure 2:
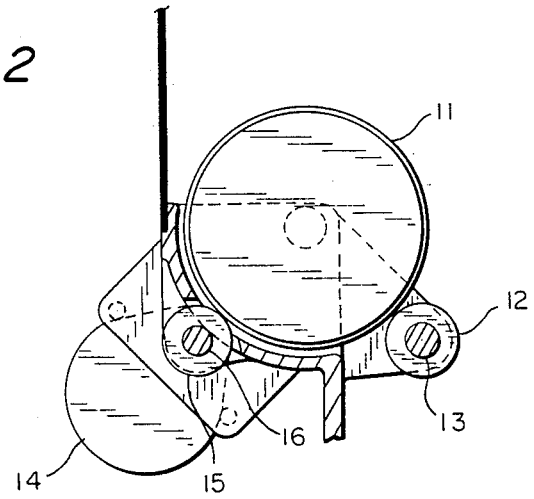
FIG. 2 is a view in cross section of the wide-mouth bottle containing the granules to be impregnated and showing the mechanism for driving said wide-mouth bottle in rotation for distribution of the last dilution in the granules.
Figure 5:
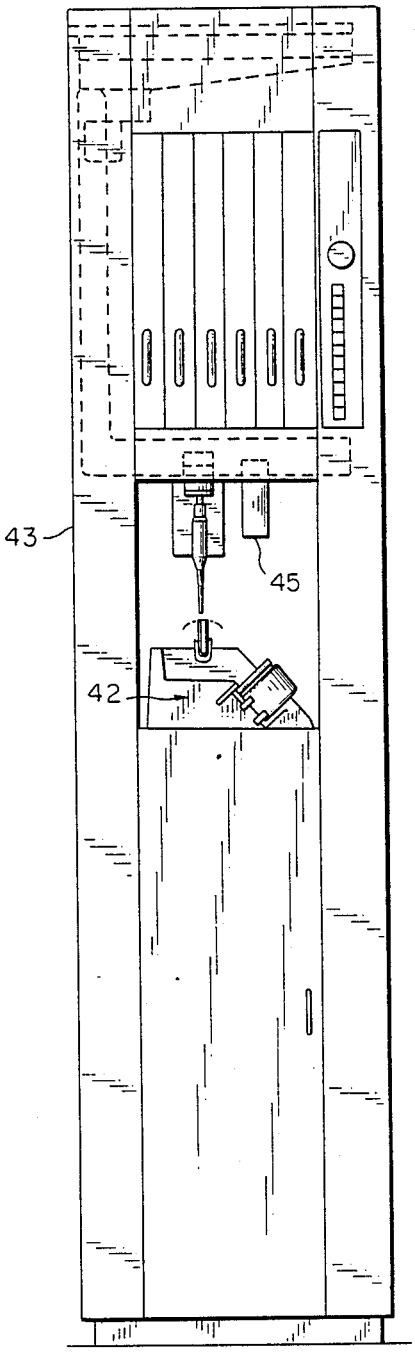
FIG. 5 represents the same column in a front view.

Now referring to FIGS. 1 and 2, it is possible to see wide-mouth bottle 11 containing granules to be impregnated, which rests by its bottom and in its center on a conical excrescence 44 and, by its periphery, on rollers 12 and 15. After having removed the cover, the preparer places wide-mouth bottle 11 already containing the granules, in impregnating position, on the cradle thus made by parts 44, 12 and 15. Rollers 12 and 15 being mounted on shafts 13 and 16, shaft 16 is driven in rotation by a gearmotor means 14 and imparts to wide-mouth bottle 11 a rotation movement which has the effect of mixing the granules together during impregnation. When the impregnation is completed, an infrared lamp 45, represented in FIG. 5, heats wide-mouth bottle 11 and its contents until evaporation of the solvent is obtained, which, at the end of the cycle, causes the granules (or globules) to be ready to distributed in their marketable packaging.

Figure 4:
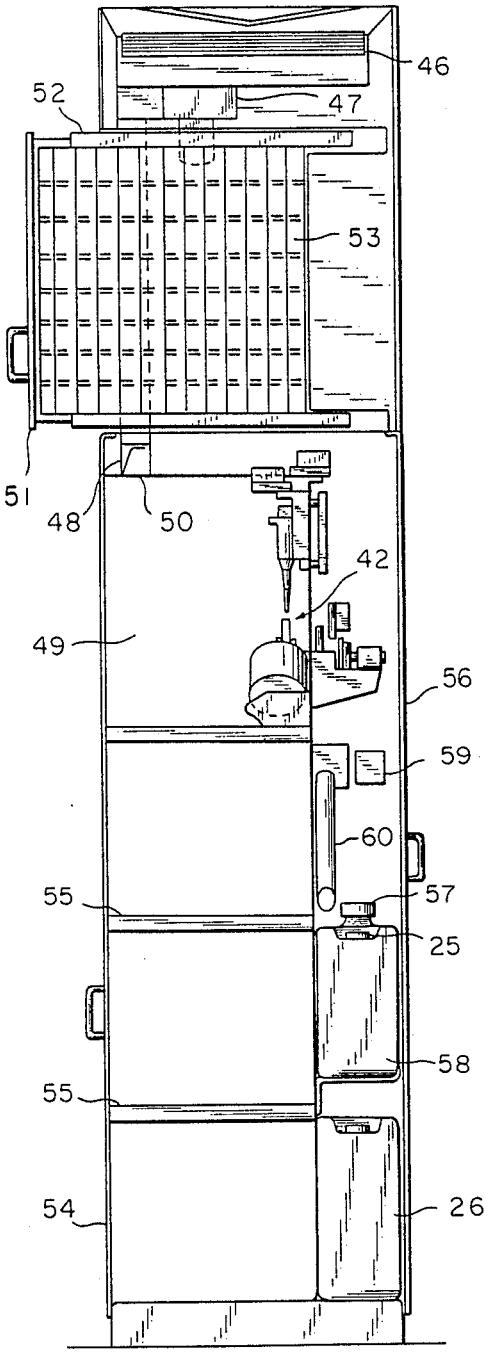
FIG. 4 is a view in vertical section of the column in which the above equipment is installed.

The device also comprises, in the lower part of the circular path of mouth 1' of flask 1 cleaning means with washing and drying comprise, as shown in FIG. 4, a pure water distribution pipe 5, a distilled water distribution pipe 6 and a pipe 8 blowing in hot air. Pipes 5, 6 and 8 go through the bottom of a tray 9 collecting waste waters which are recovered in a tank 26 which can be seen in FIG. 4 by pipe 10 shown only in FIG. 3.

Now to describe the operation of the unit of the device of the invention, reference is made to FIG. 1. This figure shows preparations flask 1 in position P1 which corresponds successively to the introduction of the dose to the diluted or rediluted, to the introduction of the solvent, and finally to performing the succussions. When these operations are completed, micropipet 2 descends to the level of the preparation to take the dose that is to serve for the following dilution of the same dilution cycle. Then micropipet 2 being lifted outside the clearance of mouth 1' of flask 1, flask 1 comes into position P2 and dilutes up the solution into a funnel 3 consisting of a cavity, shown in a dotted line, made in molded casing 62. The flow from funnel 3 leads, from a pipe not shown, to a large solvent recovery bottle 57 which can be seen in FIG. 4. From position P2 preparations flask 1 is then included in position P3, putting it opposite orifice 4 of pure water distribution pipe 5 to assure from this position a first washing of preparations flask 1. When this operation is finished, flask 1 goes into position P4 located in the axis of pipe 6 for final washing of flask 1 with distilled water. After this operation, a new inclination, this time opposite orifice 7 of pipe 8 makes it possible to blow hot air into flask 1 to assure its drying.

When these washing and drying operations are finished, flask 1 comes back into its original position P1 so that in this position the serial dilution potentization of the following dilutions or deconcentrations can be performed, up to the first programmed dilution with a view to impregnate the granules. When this point has been reached, flask 1 passes directly to position P6 for pouring onto the granules contained in wide-mouth bottle 11. The speed of passage from position P1 to P6 is selected so that the liquid is ejected and is distributed on the layer of granules contained in wide-mouth bottle 11, then, continuing its travel, flask 1 is successively in positions P3 to P5 corresponding to the washings and drying, and finally position P1 for new dilutions and potentizations, for the case where the cycle is not finished, i.e., for the case where, in the cycle of deconcentration of the same original preparations, several preparations correspond to the different concentrations are used. Now, referring to FIGS. 4 and 5, it is seen that unit 42 which has just been described, is installed in a column 43 whose different parts will now described. At the upper end can be seen an air filtering unit 46 working with a motor fan 47 for blowing purified air into an enclosure 49 by louvers 50 of a duct 48. Further, other louvers not seen in the drawing but located along duct 48 have the role of putting the whole of the inside volume of the column under slight excess pressure relative to the outside atmospheric environment. Below the filtering unit is represented a storage unit 51 serving to store the mother tinctures as well as various other homeopathic original preparations of which a minimum fraction is diluted during the cycles of serial dilution and potentization. In the preferred example, storages 51 consist of six vertical drawers working with telescopic slides 52 and each comprising compartmented racks 53. On the lower part of the front face, door 54 opens onto a storage consisting of racks 55 which serve particularly for storage of the stock of unimpregnated granules and globules, as well as tubes for their commercial packaging. On the opposite face, another door 56 opens to the maintenance part of the system, i.e., large used solvent recovery bottles 57, collection of waste washing water 26 and pure water 25 as well as the large bottle of distilled water 58, all the large bottles being connected to the dilutions and succussions device 42 by a network (not shown). Pumps 59 assure the distribution of pure water as well as distilled water to the washing means, and a compressor unit 60 with heating supplies the unit with drying.

Finally FIGS. 6 and 7 are very partial views of the device of the invention, illustrating a variation of the means of holding and driving in rotation widemouth bottle 11 receiving the granules to be impregnated. Wide-mouth bottle 11, still having its axis inclined, is placed between two parallel vertical flanges 63 and 64. It rests on a roller 65 mounted on a shaft 66 which is driven in rotation by a motor 67 and a reduction gear 68.

The device of the invention is designed particularly to assure said dilutions and potentizations automatically to the thirtieth dilution corresponding to the Codex now in force, but no limit is imposed. In practice, it is always possible on the described device to start a new deconcentration cycle from the last dilution made, so that the preparer is not at all limited if the request is made of him for a hahnemannian centesimal greater than the present Codex.

Of course, the invention is not limited to the sole embodiment of this homeopathic deconcentration and potentization device which has been described by way of example; on the contrary, it takes in all variants respecting the same principle but able to differ from the example described by their design details or their accessories.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A device for serial dilution and potentization of homeopathic remedies comprising:

at least one preparations flask having a mouth;

a means for holding said preparations flask, said means fastened to a shaft which is approximately horizontal and mounted for rotation;

said preparations flask being located approximately perpendicular to said shaft;

means provided to drive said preparations flask in rotation around said shaft and to index said preparations flask angularly so that the mouth of said flask describes a circle having said shaft as the center of the circle;

a wide-mouth bottle located in the lower half of the circular path of said flask, said bottle for containing impregnated granules where said bottle is positioned such that said flask will empty its contents into said bottle when said flask rotates into a predetermined position in the lower half of the circular path;

a used solution receptacle and flask cleaning means located near the lowest point of the circular path of said flask said flask cleaning means being positioned for cleaning said flask with a fluid, and said used solution receptacle being positioned to collect waste fluid from said flask;

said flask having an original position for introduction of a dose to be diluted, rediluted, or potentized and introduction of a solvent.

2. The device according to claim 1 wherein said shaft is also free in translation, and further including means to transmit an axial, alternating movement to said shaft.

3. The device according to claim 1 wherein said cleaning means further comprises washing means and a drying means located rear the circular path of the mouth of said flask.

4. The device according to claim 1 wherein said wide-mouth bottle rests on a cradle consisting of at least two rollers mounted on shafts and a central support for the bottom of said wide-mouth bottle.

5. The device according to claim 4 wherein at least one of said shafts carrying rollers is driven in rotation by a motor means.

6. The device according to claim 1 wherein said wide-mouth bottle is maintained in an inclined position between two parallel vertical flanges, said wide-mouth bottle resting on at least one roller mounted on a shaft and driven in rotation by a motor means.

* * * * *